US005566779A

United States Patent [19]

Dennis

[11] Patent Number: 5,566,779

[45] Date of Patent: Oct. 22, 1996

[54] INSERT FOR A DRILL BIT INCORPORATING A PDC LAYER HAVING EXTENDED SIDE PORTIONS

[75] Inventor: Thomas M. Dennis, Houston, Tex.

[73] Assignee: Dennis Tool Company, Houston, Tex.

[21] Appl. No.: 497,527

[22] Filed: Jul. 3, 1995

[51] Int. Cl.[6] ..... E21B 10/46

[52] U.S. Cl. ..... 175/426; 175/434; 51/307; 407/118

[58] Field of Search ..... 175/428, 432, 175/434, 426, 431, 430, 420.1, 420.2; 51/307; 407/118, 119; 451/540; 408/144, 145

[56] References Cited

U.S. PATENT DOCUMENTS

| | | | |
|---|---|---|---|
| 4,811,801 | 3/1989 | Salesky et al. | 175/434 |
| 4,861,350 | 8/1989 | Phaal et al. | 175/426 X |
| 5,379,854 | 1/1995 | Dennis | 175/434 |
| 5,435,403 | 7/1995 | Tibbitts | 175/432 |
| 5,486,137 | 1/1996 | Flood et al. | 175/432 X |

*Primary Examiner*—Stephen J. Novosad
*Attorney, Agent, or Firm*—Gunn & Associates, PC

[57] ABSTRACT

A drag bit is formed of an elongate tooth made of tungsten carbide and having an elongate right cylinder construction. The end face is circular at the end of a conic taper. The tapered surface is truncated with two 180° spaced flat faces at 15° to about 45° with respect to the axis of the body. The end is capped by a PDC layer.

12 Claims, 1 Drawing Sheet

INSERT FOR A DRILL BIT INCORPORATING A PDC LAYER HAVING EXTENDED SIDE PORTIONS

BACKGROUND OF THE DISCLOSURE

Drill bits are formed on a drill bit body or a set of cones which rotate in the drill bit during drilling. There are two types of tooth constructions that are prevalent today. In one instance, the teeth are fabricated from a unitary piece of metal so that the teeth are part of the drill bit body or cone. In another approach, the cone or bit body is drilled with a number of holes and teeth are inserted. In the latter instance, a harder tooth can be used. Indeed, it is possible to make inserts which mount in the formed holes in the drill bit body, the teeth being formed of much harder materials such as tungsten carbide. That is an extremely hard material. Even so, the insert tends to wear. The insert is normally protected by placing a synthetic diamond layer over the end of the insert. The synthetic diamond is sometimes known as a polycrystalline diamond compact and carries the abbreviation of PDC. In this regard, the PDC layer extends the life of the insert markedly.

The present disclosure is directed to an insert which is an elongate cylindrical body in the preferred embodiment, suitably sized and shaped, so that it fits in a hole formed in the drill bit body or some part of the bit body, and is equipped with a PDC crown or cap attached to the end of it. Such devices have been made heretofore. The present disclosure however sets forth a PDC protected insert which is ideally constructed for use in a drag bit. By way of background, some bits operate so that the teeth of the drill bit (of whatever construction) cut material by rolling so that the tooth is rolled into contact against the face of the partly finished borehole, and there are others that move the drill bit teeth across the face in a dragging motion. The roller bit construction involves a rotational movement of some part of the drill bit so that the tooth is loaded and rolls under load. This causes a crushing motion. By contrast, the tooth in a drill bit which drags across the working face operates in a different fashion. Loosely, it cuts a groove by chiseling or gouging the working face. This involves a sliding motion or a transverse motion across the face of the well borehole. Thus, the dragging motion creates a different kind of drilling motion in contrast with the rolling motion mentioned above.

The present disclosure is directed to a drag bit insert and to a drag bit insert which is constructed in a way so that the drag bit teeth last much longer. To last longer, the drag bit is equipped with teeth having the PDC crown formed on the end of the insert. Moreover, the end of the PDC insert is preferably circular so that the insert is covered completely at the end. When this is done, the covered portion of the insert is exposed to abrasion and tends to wear away. The insert body is constructed with a crown over a circular end face to assure a specified thickness of PDC material on the end of the insert. In addition to that, the insert (before the PDC layer is attached) is provided with two chamfered faces. The chamfered faces are located on opposite sides of the insert body. The tapered and chamfered faces enable the PDC material to provide an enhanced region of PDC material on the insert, thereby extending the life even when subject to losses of material due to abrasion. More particularly, the drag bit insert is installed so that the PDC crown on the end of the insert cylindrical body is joined to a larger surface area. So to speak, the insert body has a uniform conic face joined to the PDC crown except at the upstream and downstream sides of the insert body. Those are enhanced.

The present disclosure enhances performance of the insert, typically made of tungsten carbide by the incorporation of two chamfered faces which are ideally arranged 180° spacing around the body. The two or more chamfered faces are cut at an angle in the range of about 15° to about 45° with respect to the centerline axis of the insert body. The two insert chamfers thereby extend the PDC contact region. The chamfered areas form a longer skirt or face at which abrasion occurs.

Summarizing the present invention, it preferably comprises a right cylinder construction insert preferably formed of hard metal. While other hard materials can be used, an enhanced version of the equipment incorporates a tungsten carbide insert body. The tungsten carbide body is shaped with a pair of spaced. chamfered surface areas. These define chamfered areas which are approximately planar, which extend at an angle of about 15°–45° with respect to the center axis of the insert body, and which extend to a greater length along the sides so that the PDC interface with the insert body is much greater. This improves fastening of the PDC crown to the insert body and lowers heat buildup during drilling or other cutting and abrasive applications.

IN THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 of the drawings is a side view showing the insert of the present disclosure provided with a PDC crown which is adhered by joining to the end of the insert body which incorporates a pair of spaced chamfered faces; and FIG. 2 is an end view of the crown on the insert body of FIG. 1 further illustrating in dotted line the top most end face of the insert.

DETAILED DESCRIPTION OF THE PREFERRED EMBODIMENT

Figure 1:
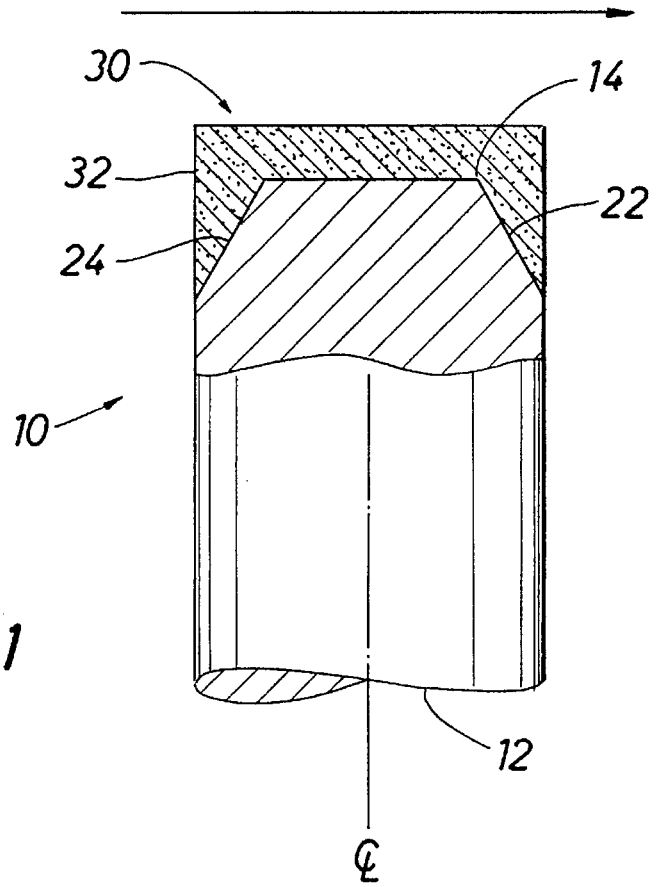

Attention is now directed to FIG. 1 of the drawings where the numeral 10 identifies the fabricated insert of the present invention. More particularly, the insert is formed with a tooth body 12 of any suitable length. It is preferably a right cylindrical construction. The insert body is formed of tungsten carbide particles in a supportive matrix. In either event, the insert has a length and diameter to enable mounting in a hole formed for that insert in a drill bit body or cone. The insert 12 is typically assembled to the body by an interference fit or brazing to assure that the insert does not wear or break free. It is installed so that the insert body is able to extend to a specified height.

Figure 2:
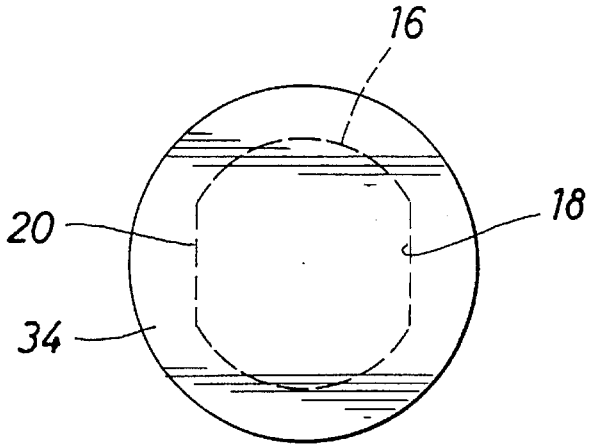

The insert body 12 is shown with a portion broken away to thereby represent that portion in sectional view. The upper end of the fabricated tooth has been broken away to illustrate the end of the tooth and the PDC layer in sectional view as will be explained. The insert body terminates at a circular region of reduced diameter in comparison with the diameter of the tooth. This is shown in FIG. 1 of the drawings where the numeral 14 represents the circular face. The dotted line representation at 16 is circular except for two or more straight edges at 18 and 21). The edges at 18 and 20 are straight line segments associated with enhanced chamfered flat faces extending at an angle downwardly with respect to the centerline axis of the tooth 12. The centerline axis is defined by the cylinder comprising the insert body. The edges 18 and 20 shown in FIG. 2 of the drawings are the upper ends of the chamfered faces 22 and 24. The faces 22 and 24 are preferably inclined at an angle with respect to the vertical of about 15° up to about 45° . The faces 22 and 24 are therefore longer than the cylindrical skirt area below the curved end face 14. Indeed, these two chamfered faces are preferably located at 180° with respect to the centerline axis of the right cylinder construction. Therefore and summarizing the significance of the faces 22 and 24, they are identical in construction, separated by 180° around the cylindrical body 12, and extend to a greater length along the side of the body. This therefore means that the PDC layer which will be described in the next paragraph has a greater contact area and mass at the cutting point.

A PDC layer is formed integrally against the body. In this particular instance, the PDC layer 30 has an encircling skirt 32. The skirt 32 has a greater contact surface area at the notches 22 and 24. In other words, the enhanced contact area increases the grip between the PDC layer and the hard metal insert 12. The PDC layer is constructed with a top most face 34 which is exposed for wear. Furthermore, the top face 34 has the shape of a circle when originally manufactured. It is a circular face which extends across the end of the body to a requisite thickness. As a representative example, the thickness is about 1 mm up to about 4 mm. The diameter of the end face is dependent on the size of the insert. The insert can have a diameter as much as about 20 mm. It is uncommon to make an insert which is larger than that. It is however practical in this instance to make the PDC layer 30 so that it is the sole and only contact material involved in the cutting process. This extends the life of the insert substantially.

An arrow has been included in FIG. 1 of the drawings to show the motion of the insert 10 with respect to the working face of the borehole during drilling. It is therefore helpful to arrange the drill bit insert on the finished bit so that the direction of movement is known. In this particular instance, the dragging motion which occurs during drilling tends to wear the drill bit insert 10 in such a fashion that the enhanced grip at the tapered faces 22 and 24 holds the PDC layer on the metal insert body 12.

The PDC layer is preferably sintered to the metal insert. This forms a layer that is relatively thin, and has been omitted from the drawings for sake of clarity. It is possible to integrally cast the PDC material in this shape. This is done in a mold at elevated pressure and temperature. Molding in place with a braze layer likewise is an adequate approach to attachment of the PDC layer to the metal insert.

In the completed device, the metal insert is constructed first. It is cut with a circular skirt around the circular end at 14. The tapered faces are formed at this time also. This locates the two faces 22 and 24 in the 180° spacing that is illustrated in the drawings. This assures the faces 22 and 24 have a length which is sufficient for attachment. At the time of installation, the insert may be placed by interference or brazing into a hole formed in the drill bit. Care must be taken to assure that the faces 22 and 24 are oriented so that the drag bit operation is certainly obtained. Finally, the device during installation is used to the point in time that the tooth breaks or the PDC crown is completely worn away. This however denotes an extremely long life insert.

While the foregoing is directed to the preferred embodiment the scope is determined by the claims which follow.

I claim:

1. A hard metal diamond coated insert comprising: an elongate insert body wherein the insert body is formed of tungsten carbide and is a right cylinder in construction and terminates at the second end with a circular end face having two ends wherein one end is adapted to be positioned in a cone or bit body, and the second end is adapted to extend therefrom for dragging across the face of a partly finished borehole and wherein the second end is covered with a PDC layer, and said PDC layer has an exposed outer face and surrounding skirt; and further wherein said insert body is formed with at least two spaced intersecting faces at an angle on the insert body and said spaced faces are arranged so that the spaced faces anchor the PDC layer on the insert body and includes enhanced skirt contact around the PDC layer aligned in accordance with the direction of movement of the insert when used in the rock drilling bit.

2. The insert of claim 1 wherein said sloping faces slope at an angle between about 15° and about 45° with respect to said PDC layer on said insert body, and said faces are substantially planar.

3. The apparatus of claim 2 wherein said insert body terminates at said circular end face which is truncated by said two sloping faces.

4. The insert of claim 4 wherein said sloping faces are arranged on said insert body so that one of said faces is on the side of said body directed toward the drag direction and the second of said faces is away from the drag direction.

5. The insert of claim 1 wherein said PDC layer conforms to the end face of said body.

6. The insert of claim 5 wherein said PDC layer and said insert body together define an elongate right cylinder.

7. The insert of claim 6 wherein said sloping faces slope at an angle between about 15° and about 45° with respect to said PDC layer on said insert body, and said faces are substantially planar.

8. The apparatus of claim 7 wherein said insert body terminates at said circular end face which is truncated by said two faces.

9. The insert of claim 8 wherein said body has a circular end face truncated by two edges.

10. An abrasion resistant insert for a cone or bit body used in earth drilling comprising a drill bit insert having an angled face located on the side of the insert facing in the direction of movement of the insert wherein the angled face is covered by a PDC layer placed thereon and joined to the insert with respect to the working face of the borehole during drilling, and a second angled face located on the side of the insert opposite the direction of movement of the insert.

11. An abrasion resistant insert for a cone or bit body used in earth drilling comprising a drag bit insert having an angled face located on the side of the insert facing opposite the direction of movement of the insert wherein the angled face is located under a PDC layer thereover and joined to the insert with respect to the working face of the borehole during drilling.

12. The insert of claim 11 wherein the insert incorporates a second angled face located on the side of the insert facing the direction of movement of the insert.

* * * * *